United States Patent [19]

Lynam

[11] Patent Number: 5,031,763

[45] Date of Patent: Jul. 16, 1991

[54] POCKET POUCH

[76] Inventor: Keith J. Lynam, 29358 Shacket, Madison Heights, Mich. 48071

[21] Appl. No.: 496,948

[22] Filed: Mar. 21, 1990

[51] Int. Cl.[5] ..... B65D 85/20

[52] U.S. Cl. ..... 206/214; 206/38; 224/230; 224/269

[58] Field of Search ..... 206/37, 38, 39, 214, 206/224, 232, 371; 224/224, 230, 268, 269, 271; 383/38, 39

[56] References Cited

U.S. PATENT DOCUMENTS

| | | | |
|---|---|---|---|
| 1,787,791 | 1/1931 | May | 206/214 |
| 3,128,514 | 4/1964 | Parker et al. | 206/37 |
| 3,371,829 | 3/1968 | Phillips | 206/232 |
| 3,619,817 | 11/1971 | Rockwell | 206/371 |
| 3,647,056 | 3/1972 | Jacobson et al. | 206/38 |
| 4,075,702 | 2/1978 | Davies | 206/232 |
| 4,189,048 | 2/1980 | Gaillard | 206/37 |
| 4,310,109 | 1/1982 | Coyle | 206/371 |
| 4,555,018 | 11/1985 | Cho | 206/224 |
| 4,705,086 | 11/1987 | O'Neill | 224/269 |
| 4,832,191 | 5/1989 | Gerver et al. | 206/232 |

*Primary Examiner*—Jimmy G. Foster
*Attorney, Agent, or Firm*—Charles W. Chandler

[57] ABSTRACT

A pocket pouch for containing pencils, credit cards, calculators and the like is described. The pouch has structure to securely prevent the contents from falling out when the pouch is turned upside down. The pouch has a flap to extend over the upper edge of the pocket.

2 Claims, 2 Drawing Sheets

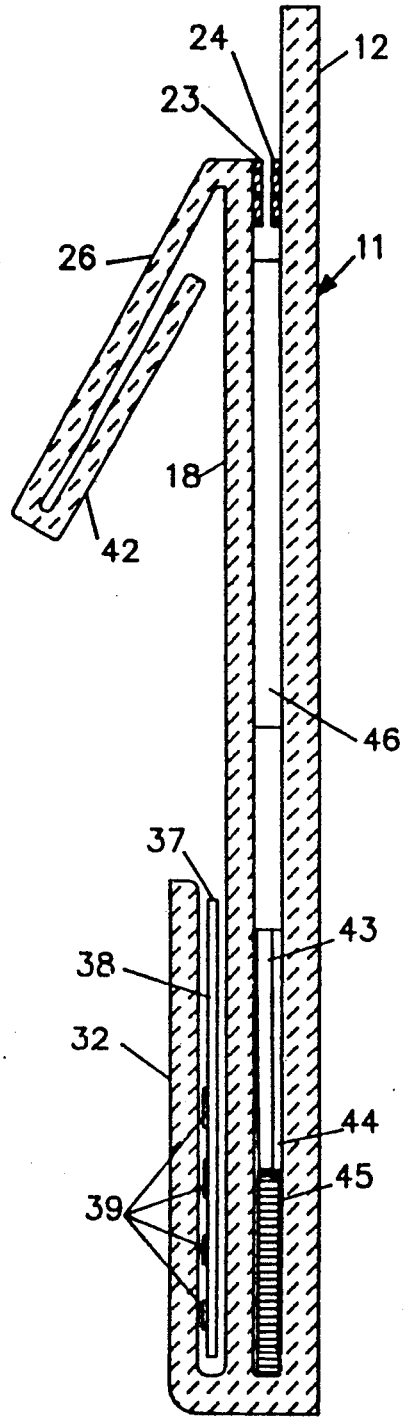
FIG. 2
FIG. 3
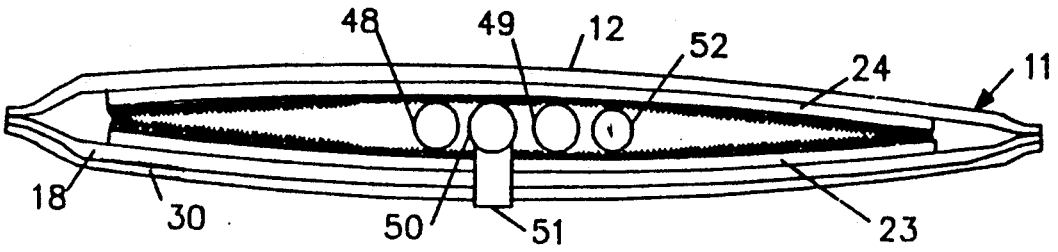

POCKET POUCH

BACKGROUND OF THE INVENTION

This invention relates to a pocket pouch of the type used to hold pencils, pens, and the like, in a shirt pocket while protecting the fabric of the shirt from being marked by the pencils. In particular, it relates to an improved pocket pouch, having hook and loop closure means to fit snugly around pens and pencils and hold them, as well as coins, and other small items more firmly and securely in place in the pouch.

Protective pouches, as used heretofore, have included a backing sheet of flexible plastic, slightly narrower than a typical shirt pocket and long enough to extend from the bottom of the pocket to above the top of it. A front sheet of the same width, but less height, is aligned with the lower part of the backing sheet and sealed to it along the vertical edges and the bottom edge to form a pouch closed at three sides. A flap is attached to the front sheet in such a way as to extend over the top edge of the pocket and be pulled toward the pocket by the natural resilience of the front sheet and the attached edge of the flat, thereby holding the edge of the pocket securely to keep the pouch in place in it. These pouches are typically made of polyethylene or a similar plastic material that is relatively smooth, so that when pencils without clips, as well as other small items, are put in it, they can easily slide out if the person wearing the pouch in his shirt pocket bends over far enough, or removes the pouch and turns it upside down to retrieve a particular item from it.

OBJECTS AND SUMMARY OF THE INVENTION

It is an object of this invention to provide a pocket pouch having means to retain pencils and the like, as well as other small items securely to prevent their falling out if the pouch is turned upside down.

Further objects will become apparent from the following description and the accompanying drawings.

In accordance with this invention, the sheets used to form a pocket pouch are provided with strips of hook and loop material, one of which strips is along the rear-facing surface of the front sheet, just below the upper edge, and the other of which strips is on the juxtaposed part of the forward-facing surface of the backing sheet to engage and hold fast to the strip on the front sheet when the two strips are pressed together.

In addition, both the flap that extends over the upper edge of the pocket and an additional flap forming a separate smaller pouch at the lower end of the front sheet can be provided with means to hold such things as business cards to identify the manufacturer or owner of the pouch and to hold other similar card-like devices, such as credit cards and calculators of the same configuration.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which:

FIG. 2 is a cross-sectional view of the pouch of FIG. 1 along the lines 2—2; and FIG. 3 is a top view of the pouch in FIG. 2 with several pens and pencils in it.

DESCRIPTION OF THE PREFERRED EMBODIMENT

Figure 1:
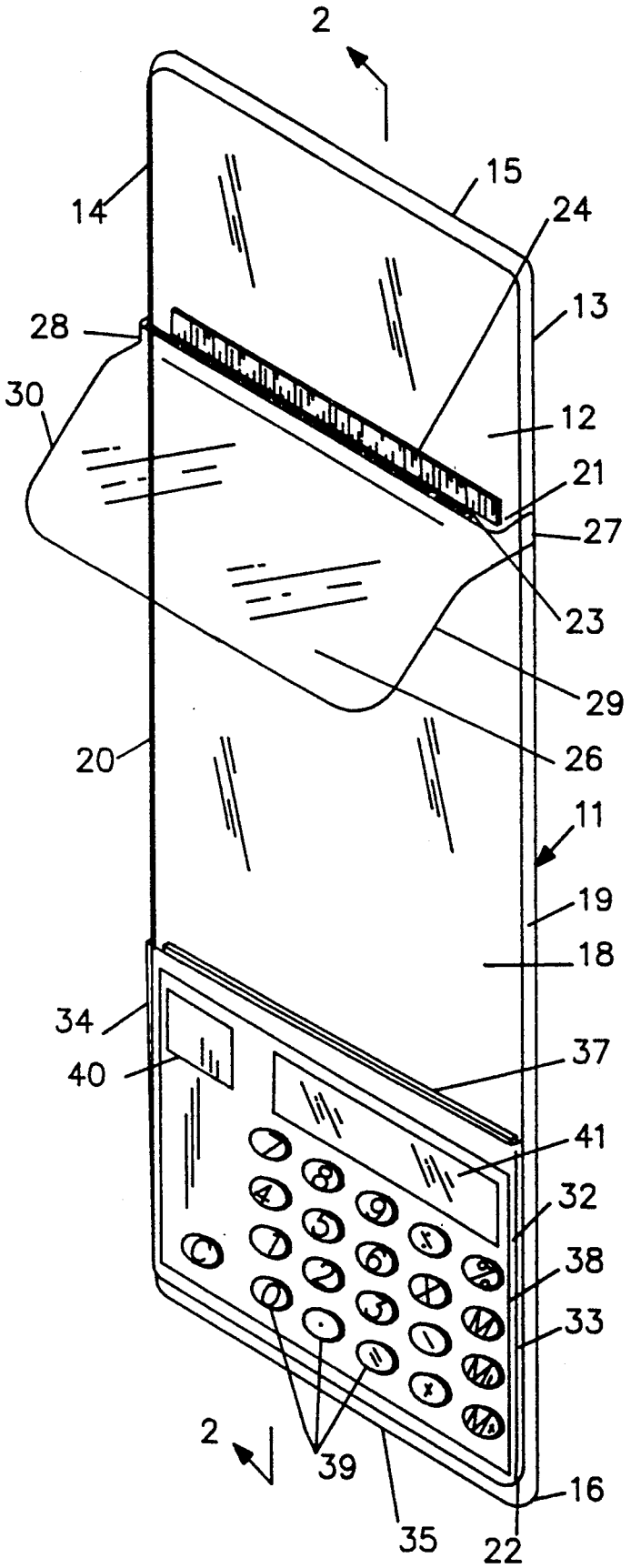
FIG. 1 is a perspective view of a pocket pouch in accordance with this invention.

The pouch 11 in FIG. 1 includes a backing sheet 12 of polyethylene, or another similar plastic material, having vertical side edges 13 and 14 and top and bottom edges 15 and 16. A front sheet 18 has side edges 19 and 20 and top and bottom edges 21 and 22. The side edges 13 and 19, or adjacent portions of the backing sheet 12 and the front sheet 18, respectively, are joined together in any suitable way, such as by being glued or heat-sealed together. In a similar manner, the edges 14 and 20, or adjacent portions, are also joined together, as are the edges 16 and 22 or adjacent portions.

The top edge 21 of the front sheet 18 is not sealed to the backing sheet, but instead has a strip of material 23 attached to its rear-facing surface, which is the surface which faces the backing sheet 12. The portion of the forward-facing surface of the backing sheet 12 has a corresponding strip 24 attached to it. One of the strips 23 or 24 has plastic hooks extending from it and the other has a plurality of loops to be engaged by the plastic hooks when the two strips are pressed together. These strips are referred to as hook and loop material and it does not matter which strip 23 or 24 is the hook of strip material and which is the strip of loop material.

In order to hold the pouch 11 in place on the breast pocket of a shirt or other garment, a flap 26 is attached to it in such a way as to pull the flap toward the forward facing surface of the sheet 18. This is conveniently done by joining short lengths 27 and 28 on the side edges 29 and 30, respectively, of the flap 26 directly to the forward facing surface of the front sheet 18. The flap 26 is typically made of the same material as the sheets 12 and 18 and may be joined to the sheet 18 in this same plastic welding process that forms the pouch itself.

In addition, a separate small pouch 32 can be attached to the front sheet 18 at the lower edge thereof. This small pouch has side edges 33 and 34 joined to the edges 19 and 20 of the sheet 18 and the bottom edge 35 joined to the bottom edge 22 of the sheet 18. The pouch 32 is just large enough to hold a card-shaped device such as a credit card calculator 37 and is preferably provided with a window 38 at least large enough to give access to the operating buttons 39 of the calculator. If the material of which pouch 32 is made is opaque, the side of the window 38 should be large enough to make it possible to view the read-out screen 40 and to allow light to have access to the light-sensitive power cells 41, typically found in such calculators.

The cross-sectional view of the view of the pocket pouch in FIG. 2 shows that the flap 26 has an end 42 folded over to form an additional pocket to receive name tags and the like. In addition, it may be seen that both the strips 23 and 24 are relatively narrow and are located at the upper level of the front sheet 18, but preferably neither strip extends above the top edge 21 of the front sheet. There is no limit to how wide these strips may be; it is only necessary that they be wide enough to be sure that they will be juxtaposed, at least in part, so that the hooks on one of the strips will securely engage the loops on the other over a sufficient total distance to keep anything in the pouch from falling out if the pouch is tilted upside down.

FIG. 2 also shows items within the pouch 11, including coins 43–45, and a credit card or the like 46. The items shown within the pouch are only illustrative of its many uses and are not to be considered as limiting the invention. The secure engagement of the hook and loop strips 23 and 24 makes the pouch a convenient and secure device for carrying not only such things as pens and pencils but also cards and coins that might otherwise be lost or disfigured if carried loose in the pocket of the person wearing the pouch.

FIG. 3 shows one of the distinct advantages of the present invention in holding a plurality of cylindrical structures that may be of the same or differing diameters. The structures shown in FIG. 3 include two ballpoint pens 48 and 49, a somewhat larger retractable ballpoint pen 50 with a clip 51, and a pencil 52. The clip 51 would hold the pen 50 in place in the pouch even in the absence of this invention, but the other pens 48 and 49 and the pencil 52 have no such retaining device. However, it will be noted that the hook and loop strips 23 and 24 are pressed together to constrict the mouth of the pouch to cause it to fit somewhat closely around the pens 48–50 and the pencil 52 and to permit no sidewise movement of any of them. I have found that this is efficacious in retaining any such cylindrical devices in place in the pouch, even if the person wearing the pouch frequently has to bend over in connection with work activities. The hook and loop strips 23 and 24 extend nearly the full width of pouch 11 in this embodiment, and it is desirable that they do so since this provides a wider area in which to receive pens, pencils, and the like. Even though the hook and loop strips are stiff enough to prevent their fitting precisely around the pens and pencils, there is still sufficient frictional engagement between the hooks and loops and the pencils to prevent any release of these cylindrical devices, and there is also sufficient engagement to close the upper part of the pouch sufficiently to prevent any coins that might be in it, in addition to the cylindrical devices, as well as any cards and the like, from falling out.

While the strips 23 and 24 can be put into position and held in place by glue after the backing sheet 12 and the front sheet 18 has been joined together, it is preferable to attach the strip 24 to the backing sheet and the strip 23 to the front sheet 18 before the edges of those sheets are permanently joined together.

This invention has been described in specific terms, but it is to be understood that it may be modified without departing from the scope defined by the following claims.

What is claimed is:

1. A pocket pouch suited for insertion in a shirt pocket, comprising:

a generally rectangular backing sheet having top and bottom edges spaced in a longitudinal direction, two side edges spaced in a transverse direction, and forward-facing and rear-facing surfaces;

a generally rectangular front sheet having forward-facing and rear-facing surfaces, a top edge, a bottom edge jointed to the bottom edge of the backing sheet, and two side edges, regions of the front sheet adjacent the side edges thereof being joined to regions of the backing sheet adjacent the respective side edges of the backing sheet for only part of the length of the side edges of the backing sheet, whereby a portion of the backing sheet adjacent the top edge thereof extends beyond the top edge of the front sheet and the thus-joined sheets form a pouch having an opening along the top edge of the front sheet for receiving a plurality of elongated articles such as writing instruments;

a flap joined to the forward-facing surface of the front sheet adjacent the top edge thereof and extending part of the way from the top edge of the front sheet toward the bottom edge thereof adjacent the forward facing surface of the front sheet to hold the top edge of a shirt pocket between the flap and the front sheet;

closure means comprising parallel, juxtaposed strips of complementary hook and loop releasable fastener material, one of the strips being joined to the rear-facing surface of the front sheet, adjacent the top edge, thereof, and the other of the strips being joined to the forward-facing surface of the backing sheet, the strips extending across the sheets in the transverse direction thereof between the joined regions adjacent the respective side edges thereof, whereby exerting pressure on the forward-facing surface of the front sheet and the rear-facing surface of the rear sheet in the region of the hook and loop strips causes portions of the strips alongside the elongated articles to releasably lock together and frictionally engage the elongated articles; and a third, generally rectangular sheet joined along the bottom edge of the front sheet and upwardly toward the top edge thereof along both side edges to a position below the lower edge of the flap to form a pocket having a top opening for receiving a solar powered calculator, the third sheet being so formed as to permit viewing of the read-out screen of the calculator, and to permit light to have access to the light sensitive power cells of the calculator.

2. A pocket pouch as defined in claim 1, in which the flap is folded along the bottom edge thereof to form a pocket between the flap and the front sheet suitable for receiving a name tag, the flap being so formed as to permit viewing of the name tag through the flap.

* * * * *